US012013217B2

(12) United States Patent
Bopp et al.

(10) Patent No.: US 12,013,217 B2
(45) Date of Patent: Jun. 18, 2024

(54) PROTECTIVE SHIELD

(71) Applicant: Bonowi International Police Equipment GmbH, Mainz (DE)

(72) Inventors: Wolfgang Bopp, Mainz (DE); Oliver Wehnl, Weiterstadt (DE)

(73) Assignee: Bonowi International Police Equipment GmbH, Mainz (DE)

( * ) Notice: Subject to any disclaimer, the term of this patent is extended or adjusted under 35 U.S.C. 154(b) by 488 days.

(21) Appl. No.: 17/183,764

(22) Filed: Feb. 24, 2021

(65) Prior Publication Data

US 2021/0270574 A1 Sep. 2, 2021

(30) Foreign Application Priority Data

Feb. 27, 2020 (DE) ..... 202020101070.0

(51) Int. Cl.
*F41H 5/08* (2006.01)
*F41H 5/007* (2006.01)
*F41H 5/04* (2006.01)

(52) U.S. Cl.
CPC ..... *F41H 5/007* (2013.01); *F41H 5/0471* (2013.01); *F41H 5/08* (2013.01)

(58) Field of Classification Search
CPC ..... F41H 5/08
See application file for complete search history.

(56) References Cited

U.S. PATENT DOCUMENTS

| | | | |
|---|---|---|---|
| 3,745,938 | A | 7/1973 | Hathaway et al. |
| 5,377,577 | A | 1/1995 | Bounkong et al. |
| 6,807,890 | B1 | 10/2004 | Fuqua |
| 8,210,088 | B1 | 7/2012 | Keyfauver |

FOREIGN PATENT DOCUMENTS

| | | | |
|---|---|---|---|
| DE | 3142635 | A1 | 5/1983 |
| DE | 19805638 | A1 | 8/1999 |
| DE | 202011051144 | U1 | 11/2011 |
| DE | 202012010341 | U1 | 2/2014 |
| DE | 202013010467 | U1 | 2/2015 |
| GB | 2518669 | A | 4/2015 |
| GB | 2573810 | A | 11/2019 |

OTHER PUBLICATIONS

German Search Report dated Feb. 17, 2021 for German Patent Application No. 202020101070.0.
European Search Report dated Nov. 26, 2021 for European Patent Application No. 21158953.6.

*Primary Examiner* — J. Woodrow Eldred
(74) *Attorney, Agent, or Firm* — Bachman & LaPointe, P.C.

(57) ABSTRACT

A protective shield has an at least approximately rectangular base body. A first connecting element is at a first edge of the base body. A second connecting element is at a second edge of the base body opposite the first end. The first and the second connecting elements are each arranged as part of a positive-locking connection system.

23 Claims, 4 Drawing Sheets

PROTECTIVE SHIELD

CROSS-REFERENCE TO RELATED APPLICATION

Priority is claimed of German Patent Application No. DE202020101070U1, filed Feb. 27, 2020, and entitled "Protective Shield", the disclosure of which is incorporated by reference herein in its entirety as if set forth at length.

BACKGROUND

The invention relates to a protective shield.

A protective shield of the type mentioned at the beginning is known from the document DE 20 2011 051 144 U1. This protective shield (called protective cover there) consists of an at least approximately rectangular base body, wherein a first connecting element is arranged at a first edge of the base body and a second connecting element is arranged at a second edge of the base body opposite the first edge. In this solution, said connecting elements are designed as suction cups. The above-mentioned requirement "at least approximately rectangular" means in this case, and also for the invention explained below, that the base body has four edges, two of which run parallel to one another in each case, although the transition from one edge to the other can, for example, be designed to be more or less rounded.

SUMMARY

The invention is based on the task of improving a protective shield of the type mentioned above. In particular, the aim is to create a protective shield that can be used even more flexibly.

This task is solved with a protective shield comprising the features of claim 1.

Thus, according to the invention, it is provided that the first and second connecting elements are each formed as part of a positive connection system.

In other words, the protective shield according to the invention is thus characterized by the fact that an option has been created for connecting the base body to at least one further base body also provided with the connection system, which brings with it the advantage that, according to the invention, a rescue stretcher formed from a plurality of base bodies, for example, or also a particularly large and stable protective shield can be formed. The suction cups provided in the aforementioned prior art are unsuitable for this purpose.

Other advantageous further embodiments of the protective shield according to the invention are apparent from the dependent claims for protection.

The protective shield according to the invention, including its advantageous further embodiments according to the dependent patent claims, is explained in more detail below with reference to the graphic representation of a preferred embodiment.

DETAILED DESCRIPTION

Figure 1:
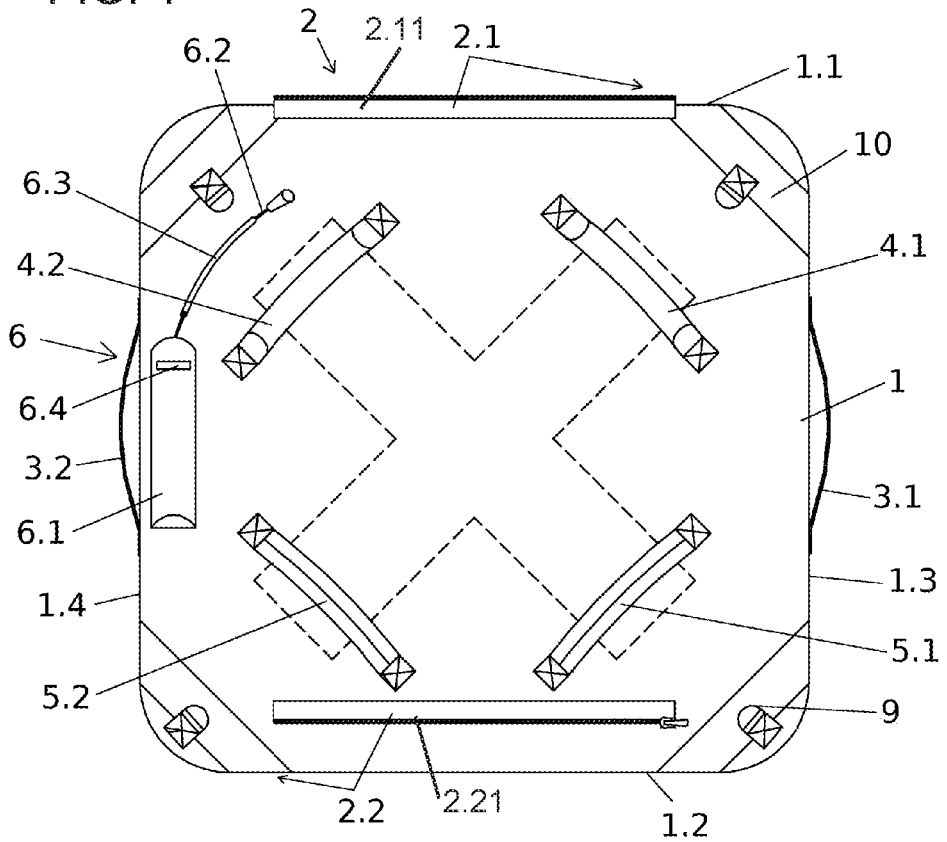
FIG. 1 shows the body side of the shield according to the invention.
Figure 2:
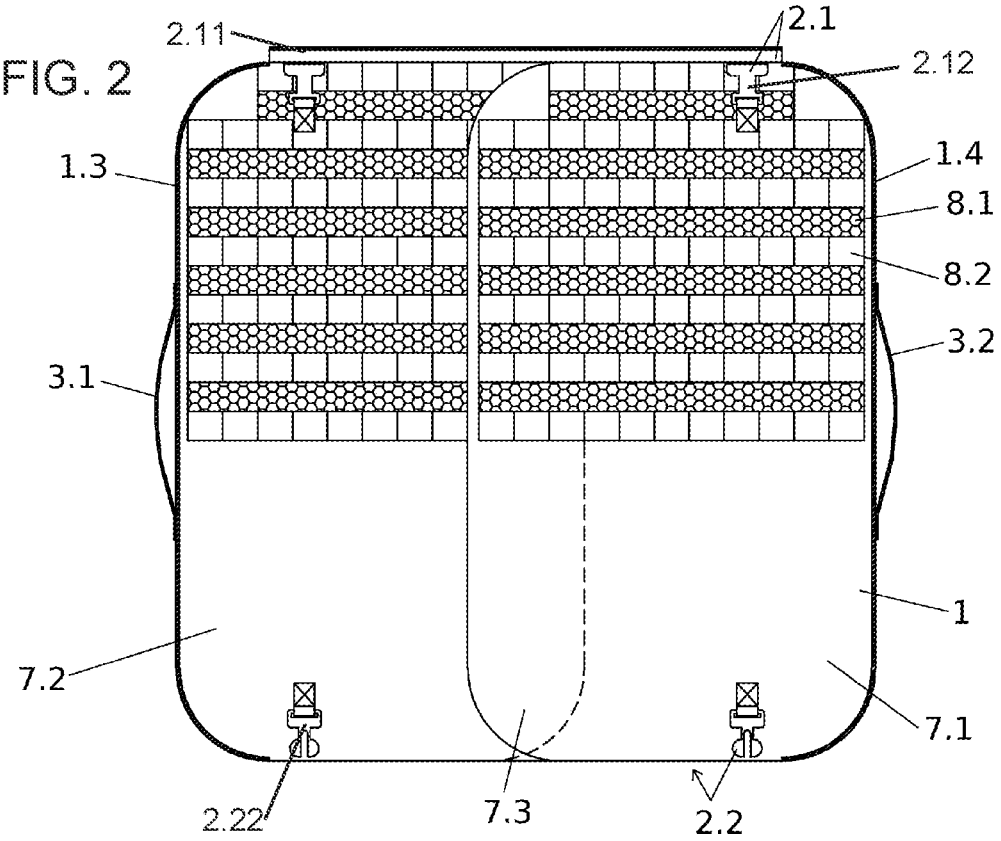
FIG. 2 the attack side of the shield according to the invention.

The protective shield shown in FIG. 1 and FIG. 2, which serves as impact protection, stabbing protection and/or bullet protection, comprises first of all of an at least approximately rectangular base body 1, wherein this—viewed more closely—is particularly preferably, as shown, square with rounded corners. The base body can be designed to be bullet-resistant and/or punch-resistant. Furthermore, a first connecting element 2.1 is arranged on/along a first edge 1.1 of the basic body 1 and a second connecting element 2.2 is arranged on/along a second edge 1.2 of the basic body 1 opposite the first edge 1.1.

As mentioned above, the base body 1, which is preferably formed from a flexible material, in particular fabric, has a body side and an attack side. By body side is meant here that side of the protective shield which faces the body of the wearer of the protective shield when in use. The attack side faces away from the body of the wearer of the protective shield, but faces a possible attacker. As an option the flexible material on the attack side and/or on the body side can comprise a punch and/or bullet-resistant material, e.g., a textile or fabric, in particular comprising aramid fibers.

It is now essential for the protective shield according to the invention that the first and the second connecting elements 2.1, 2.2 are each formed as part of a positively acting connecting system 2.

It is further particularly preferred—initially considered in general terms—that the connecting system 2 is formed from at least one of a zipper fastener, a plug-in connector (for example in the form of a belt or strap buckle), a hook and loop fastener (e.g., the two complementary parts (moieties)), toggles, ribbons, and a snap fastener. The at least one of a zipper, a plug-in connector, a hook and loop fastener, toggles, ribbons, and snap fastener can be arranged on the body side and/or at least one of a zipper, a plug-in connector, a hook and loop fastener, toggles, ribbons, and snap fastener can be arranged on the attack side of the base body 1.

In the figures themselves, the "and" variant of the two aforementioned options is shown in each case, i.e. an embodiment example in which the connection system 2 exists twice, namely once as a zipper arranged on the body side and once as a connector arranged on the attack side. Thus, in the illustrated example, the first connecting elements 2.1 are a first zipper moiety 2.11 (e.g., tooth tape without slide) and a first pair of buckle moieties 2.12 (e.g., female) while the complementary second connecting elements 2.2 are a second zipper moiety 2.21 (e.g., tooth tape with slide) and a second pair of buckle moieties 2.22 (e.g., male).

Figure 4:
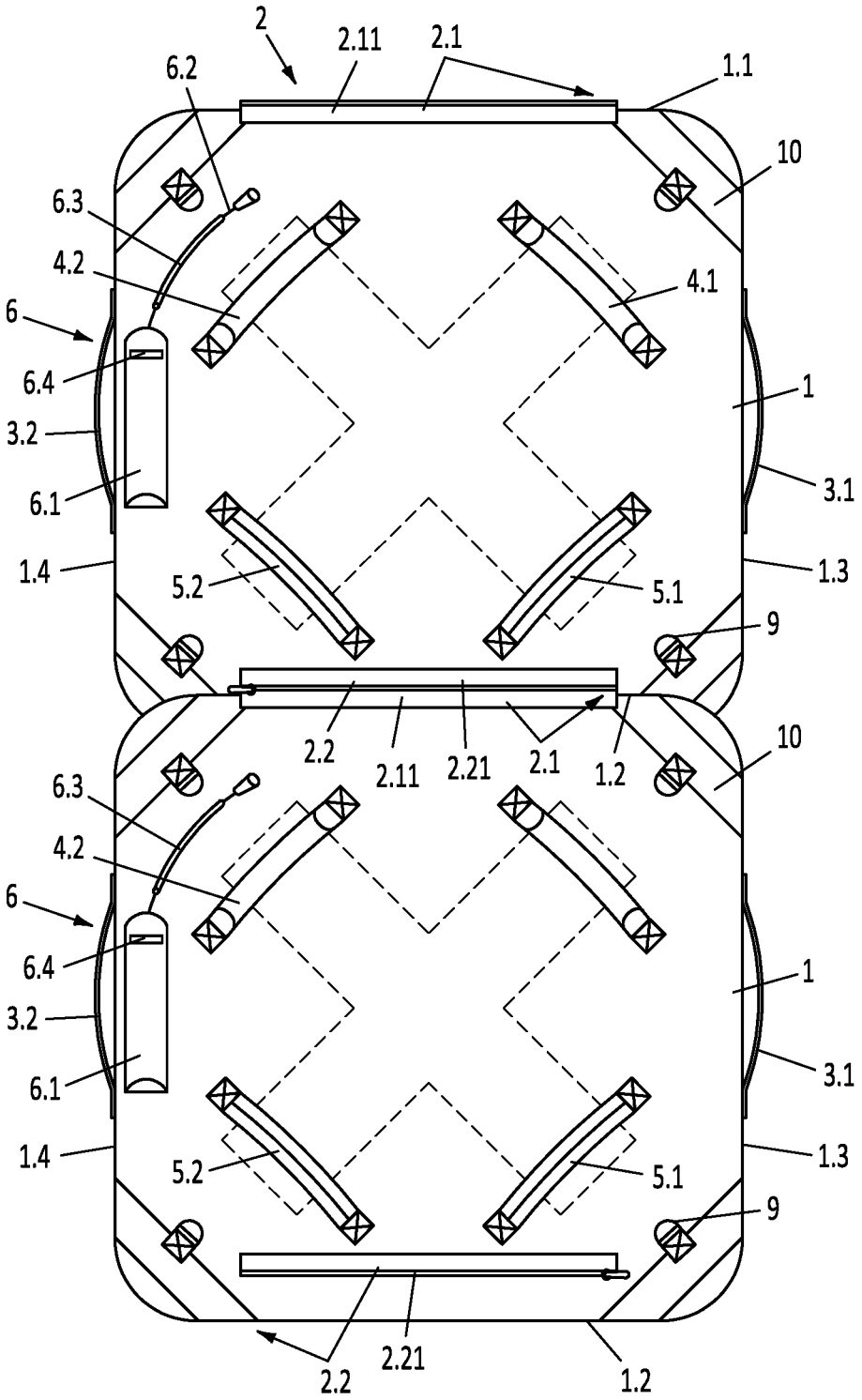
FIGS. 4 and 5 respectively body and attack sides of two connected shields.
Figure 5:
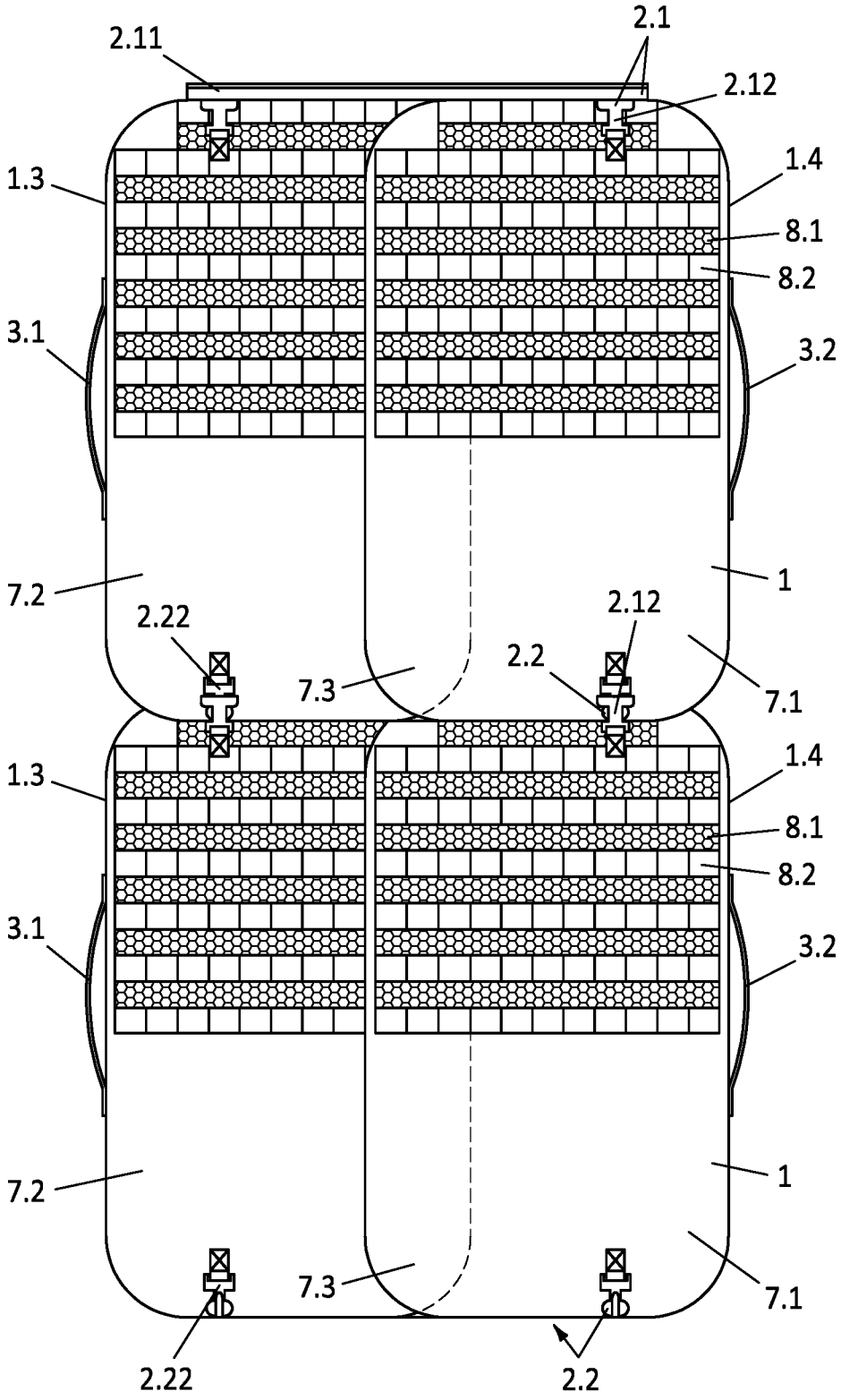

Considered still somewhat more closely, it is particularly preferably provided in this connection for realizing an overlap (FIGS. 4 and 5) of two connected basic bodies 1 that, when the connection system 2 is designed as a zipper, the first connection element 2.1 is arranged exactly at the first edge 1.1 and the second connection element 2.2 is arranged at a distance from the second edge 1.2, wherein the distance is preferably in the range of 1 cm to 20 cm, in particular in the range of 5 cm to 15 cm.

Furthermore, when the connection system 2 is designed as a connector, two connectors are arranged both on the first edge 1.1 and on the second edge 1.2, in each case in the region of the corners of the protective shield.

As can be readily seen from the figures, it is possible in this way to connect two or more protective shields (e.g., identical shields) to one another, on the one hand, via body-side zippers and, on the other hand, via attack-side connectors, in order to form in this way, for example, a particularly large protective surface or a rescue stretcher.

Particularly because of the latter option, lifting handles 3.1, 3.2 are thereby preferably arranged on the base body 1, wherein, viewed more closely, it is particularly preferably provided that a lifting handle 3.1 is arranged on a third edge 1.3 of the base body 1 and a further lifting handle 3.2 is arranged on a fourth edge 1.4 of the base body 1, which is opposite the third edge.

As can be seen from FIG. 1, it is also preferably provided that two carrying handles 4.1, 4.2 are arranged on the body side of a first half of the basic body 1 (upper half when used as intended) and two carrying straps 5.1, 5.2 are arranged on a second half of the basic body 1 (lower half when used as intended). In particular, the carrying straps 5.1, 5.2 are adjustable and/or padded.

Considered still somewhat more closely, it is particularly preferably provided in this connection that the carrying handles 4.1, 4.2 and the carrying (wear or support) straps 5.1, 5.2 are arranged on edges of an imaginary rectangle on the base body 1, which rectangle is preferably twisted between 30° and 60°, particularly preferably by 45°, with respect to the base body 1. Or in other words: the carrying handles 4.1, 4.2 and/or the carrying straps 5.1, 5.2 are preferably arranged at right angles to one another. In this regard, as can be seen from FIG. 1, these dimensions lead to the fact that the protective shield can be carried with the left or right arm, whereby the user, for example, passes his left arm under the left carrying strap 5.2 and then holds the right carrying handle 4.1 with the hand of this arm. If the right arm is to be used to carry the protective shield, the right carrying strap 5.1 and the left carrying handle 4.2 are used accordingly.

Furthermore, it is particularly preferred that the carrying straps 5.1, 5.2—in the event that an attacker should pull or turn the protective shield with a great deal of force—are provided with preferably concealed predetermined breaking points. This provision has the advantage that the user of the protective shield can let go of it if necessary, which would not be the case if his arm were "trapped" behind a carrying straps 5.1, 5.2.

As with the prior art mentioned at the beginning, it is also preferably provided in the case of the protective shield according to the invention that the base body 1 is provided with an inflatable stiffening device 6 for its stiffening as required, i.e. depending on the situation at the point of use, the user can decide, whether—without using the stiffening device 6—he would preferably like to use a relatively flexible protective shield with which, for example, he can also easily pass through narrow places, or whether he would preferably use a protective shield which, thanks to the stiffening device 6, is designed to be rigid like a board. More precisely, the protective shield, which can also serve as a splinter protection, is provided with an inflatable air chamber system, which, similar to an air mattress, stiffens the bullet-resistant blanket. The stiffening element or the air chamber system is preferably inflated by means of a compressed air cartridge or the like. Furthermore, it is ensured that the at least one stiffening element or the air chamber system is also designed to be puncture-resistant or bullet-resistant so that it does not lose its tensioning effect in the event of a hit.

For this purpose, it is furthermore particularly preferably provided that the stiffening device 6, which in particular also comprises (with respect to the base surface of the protective shield) gas channels on the edge side (not shown separately), has a gas cartridge 6.1, preferably a carbon dioxide cartridge, with a pulling element 6.2, preferably a rope or a chain, for triggering the stiffening (i.e. filling the gas channels). The gas cartridge 6.1 can be in fluid connection with the air chamber system for inflating the air chamber system as required. The air chamber system can be located between the attack side and the body side of the base body 1 in order to protect the air chamber system against puncture by means of the puncture and bullet-resistant material of the base body 1.

As again can be seen from FIG. 1, it is also preferably provided that a guide 6.3, which is designed to guide the pulling element 6.2 and runs in the pulling direction of the pulling element 6.2, is arranged on the base body 1. This guide 6.3 for the tension element 6.2, which prevents canting during release, is preferably made of fabric and is preferably sewn onto the base body 1.

As can also be seen from FIG. 1, it is preferably provided that the gas cartridge 6.1 is arranged between the base body 1 and a cover attached to the base body 1. In order to be able to immediately recognize the status or condition of the gas cartridge 6.1 despite the cover, a viewing window 6.4 for the gas cartridge 6.1 is thereby quite preferably provided on the cover.

In addition to the aforementioned stiffening device 6, with reference to FIG. 2, a further, very advantageous design feature of the protective shield according to the invention is that two pockets 7.1, 7.2, preferably extending over the entire surface of the base body 1, are provided on the base body 1 for receiving plate (panel) elements 11. These plate elements 11 are preferably designed to be bullet-resistant within the meaning of DIN EN 1522 (e.g., layered aramid fiber fabric optionally stiffened by gas from the gas cartridge; or stiff and molded of aramid fiber composites, ultra-high molecular weight polyethylene (UHMW PE), and the like). In addition, it is preferably provided that each pocket 7.1, 7.2 is designed to be closable with a zipper provided at the third edge 1.3 and at the fourth edge 1.4, respectively, so that the plates can be inserted into the protective shield in a simple manner.

To ensure that no gap remains between the two plate elements when the protective shield is in use, it is further particularly preferably provided that, in order to form an overlap region 7.3, each pocket 7.1, 7.2 is designed to be more than half as large as the base body 1 or its base area; that is to say, an overlapping insertion of the plate elements is provided, whereby the protective shield, provided that the stiffening device 6 has not been triggered, can still be used quite flexibly despite the plate elements, because it can be bent approximately centrally. Moreover, it is particularly preferred that the overlapping area 7.3 is designed to extend from the first edge 1.1 to the second edge 1.2 (i.e. from top to bottom when used as intended).

Furthermore, again with reference to FIG. 1, it is particularly preferred that eyelets 9 for a carrying strap (not shown separately) are arranged on the body side at all four corner regions of the basic body 1. The said carrying strap preferably has an elastic part for increasing the carrying comfort.

In addition, rubber bands 10 are preferably arranged at all four corner regions of the base body 1, under which the said eyelets 9, if they are not required in use, can be (at least partially) concealed.

With reference to FIG. 2, for the fastening of items of equipment, it is preferably provided that the base body 1 is provided on the attack side (partially or also over the entire surface) optionally with loop tape 8.1 and/or with so-called MOLLE tape 8.2 (more precisely: "ladder-shaped pocket fastening system"—see also https://en.wikipedia.org/wiki/Pouch_Attachment_Ladder_System), wherein, as shown, the loop tape 8.1 (loop or fleece tape moiety of a hook and loop fastener system) and the MOLLE tape 8.2 are particularly preferably arranged alternately on the basic body 1. Instead of the aforementioned MOLLE tape 8.2, however, a textile laminate provided with preferably laser-cut slits can also be provided.

Figure 3:
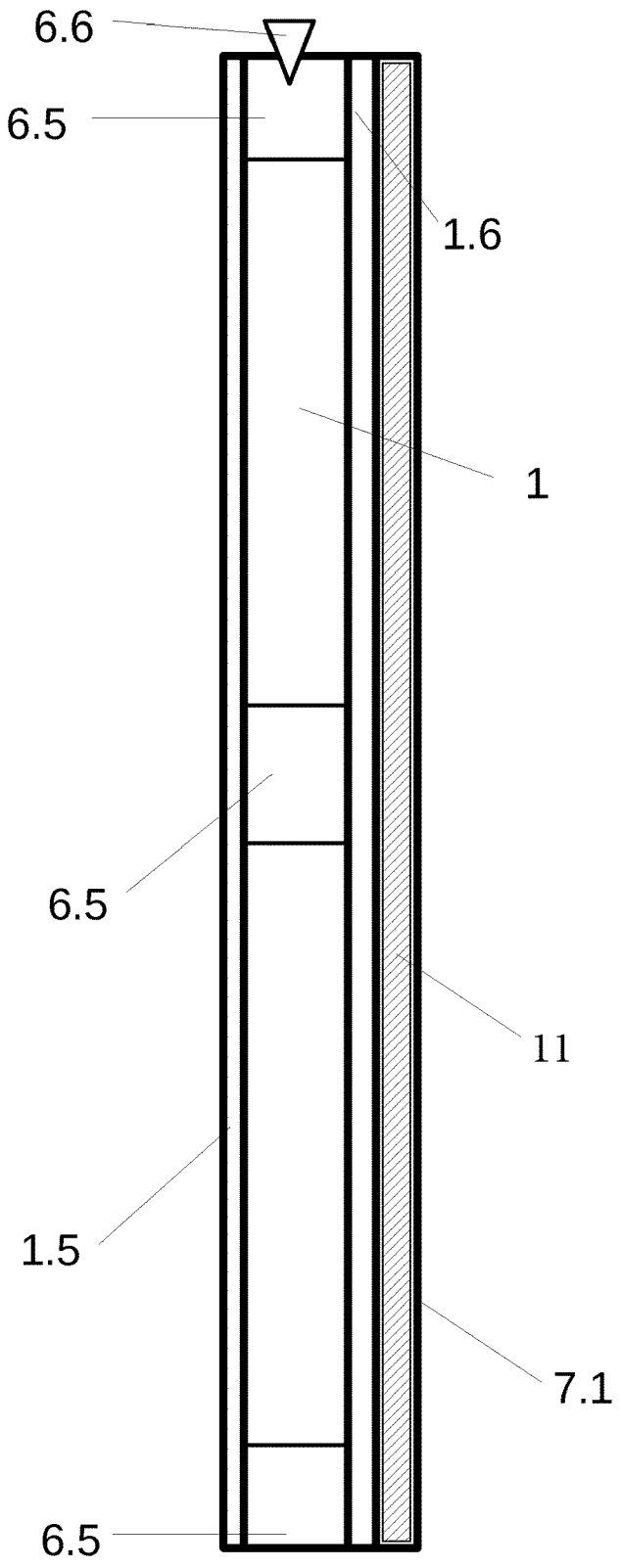
FIG. 3 the shield in a section.

FIG. 3 shows the protective shield in section. The protective shield shown in the figures has a penetration or bullet-resistant, cover-shaped, collapsible or collapsible base body 1 on from a corresponding strong (fabric) material on which at least one stiffening element 6 is arranged for clamping. The one or more gas channels 6.5 of the stiffening element 6 can be inflated with gas in order to stretch the base body 1, which gas can be provided by the gas cartridge 6.1. The result is that the gas ducts 6.5 can likewise be designed to be collapsible, rollable or collapsible. Thus the foldable protective shield be accommodated to save space when not in use. The one or more gas channels 6.5 of the stiffening element 6 can be designed in the shape of a hose and in particular can be arranged on the edge of the base body 1. In order to inflate the protective shield, an exchangeable gas cartridge 6.1 can be used for inflating the stiffening element 6. The gas channels 6.5 are located between the attack side 1.5 and the body side 1.6 of the base body 1 in order to protect the gas channels against puncture by means of the puncture and/or bullet-resistant material of the base body 1 on the attack side 1.5 and/or the body side 1.6.

In order to be able to easily pack the protective shield again, for example after use, the stiffening element 6 can be provided with at least one drain valve 6.6. More than one gas channel 6.5 or more than one stiffening element 6 can also be provided. The stiffening element 6 can preferably have a chamber system (optionally with several chambers) distributed over the base body 1. In this way (after inflation) an overall stiff, wall-like protective shield results, which can be used in particular as a protective wall, but also, for example, as a rescue stretcher for transporting the injured, a swimming aid or even a life raft.

The protective shield can have one or more pockets 7.1, 7.2, preferably on the attack side of the base body 1, wherein each pocket 7.1 is designed for receiving plate (panel) elements 11. These plate elements 11 are preferably bullet-resistant and/or punch resistant. Each of the one or more pockets 7.1 can be closable, e.g. by means of a zipper, in order to keep the plate elements 11 in place.

LIST OF REFERENCE SIGNS

Below is a list of reference signs used in the drawings:

1 Base body
1.1 First edge of the base body
1.2 Second edge of the base body
1.3 Third edge of the base body
1.4 Fourth edge of the base body
1.5 Attack side of the base body
1.6 Body-side of the base body
2 Connection system
2.1 First connecting element (fastener(s))
2.11 First zipper
2.12 First buckles
2.2 Second connecting element (fastener(s))
2.21 Second zipper
2.22 Second buckles
3.1 Lifting handle
3.2 Lifting handle
4.1 Carrying handle
4.2 Carrying handle
5.1 Wear strap
5.2 Wear strap
6 Stiffening device
6.1 Gas cartridge
6.2 Drawing element
6.3 Guide
6.4 Viewing window
6.5 Gas channel
6.6 Valve
7.1 Pocket
7.2 Pocket
7.3 Overlap area
8.1 Fleece tape
8.2 MOLLE tape
9 Eyelet
10 Rubber bands
11 Plate element

What is claimed is:

1. A protective shield comprising an at least approximately rectangular base body, wherein:
- the base body has a body side and an attack side;
- at a first edge of the base body a first connecting element is on the body side;
- at a second edge of the base body opposite the first, a second connecting element is on the body side;
- the first and the second connecting elements are each arranged as part of a connection system for connecting the protective shield to another shield;
- the connection system comprises a zipper comprising said first and second connecting elements, wherein the first connecting element is exactly on the first edge and the second connecting element is at a distance from the second edge.

2. The protective shield of claim 1, wherein the distance is 5 cm to 0.15 cm.

3. The protective shield of claim 1, wherein the connection system further comprises buckles on the attack side of the base body.

4. The protective shield of claim 3, wherein, each buckle of the buckles has a first moiety near the first edge and a second moiety near the second edge, the first moiety of each buckle being complementary to the second moiety of said buckle.

5. The protective shield of claim 1, wherein the base body has lifting handles, wherein one lifting handle is arranged on a third edge of the base body and a further lifting handle is arranged on a fourth edge of the base body opposite the third edge.

6. The protective shield of claim 1, wherein two carrying handles are arranged on a first half of the base body and two carrying straps are arranged on a second half of the base body.

7. The protective shield of claim 6, wherein the carrying handles and the carrying straps are arranged on edges of an imaginary rectangle on the base body, which rectangle is rotated between 30° and 60° relative to the base body.

8. The protective shield of claim 6, wherein the carrying straps have predetermined breaking points.

9. The protective shield of claim 1, wherein the base body has an inflatable stiffening device for its stiffening the base body.

10. The protective shield of claim 9, wherein the stiffening device has a gas cartridge with a pulling element for triggering the stiffening, wherein a guide designed to guide the pulling element and running in the pulling direction of the pulling element is arranged on the base body.

11. The protective shield of claim 10, wherein the guide for the pulling element is formed of fabric.

12. The protective shield of claim 11, wherein two pockets for receiving plate elements are provided on the base body.

13. The protective shield of claim 12, wherein each pocket is more than half width of the base body in order to form an overlap region.

14. The protective shield of claim 13, wherein the overlap region is formed extending from the first edge to the second edge.

15. The protective shield of claim 14, wherein the base body has at least one of a hook and loop fastener loop tape and a pouch attachment ladder system tape on the attack side.

16. A protective shield comprising:

a body having:

a first face and a second face opposite the first face; and a first edge and a second edge opposite the first edge;

a first connecting element comprising a first zipper moiety on the first face;

a second connecting element complementary to the first connecting element, and comprising a second zipper moiety on the first face matable to the first zipper moiety, wherein:

the first and the second connecting elements are configured to mate the protective shield to an identical second protective shield with a first portion of the protective shield adjacent the first edge of the body of the protective shield overlapping a second portion of the second protective shield adjacent the second edge of the body of the second protective shield.

17. The protective shield of claim 16, wherein:

the first connecting element comprises:

a first pair of buckle moieties; and the second connecting element comprises:

a second pair of buckle moieties matable to the first pair of buckle moieties.

18. The protective shield of claim 16, wherein:

the body comprises two pockets for receiving plate elements; and each pocket is more than half a width of the base body in order to form an overlap region for the plate elements.

19. A method for mating the protective shield of claim 16 to a second protective shield, the second protective shield comprising:

a body having:

a first face and a second face opposite the first face; and a first edge and a second edge opposite the first edge;

a first connecting element comprising a first zipper moiety on the first face;

a second connecting element complementary to the first connecting element, and comprising a second zipper moiety on the first face matable to the first zipper moiety, the method comprising:

mating the protective shield first connecting element to the second protective shield second connecting element.

20. The method of claim 19 wherein:

for each of the first protective shield and the second protective shield, the body comprises two pockets receiving plate elements; and the mating overlaps said plate elements of the protective shield and the second protective shield.

21. A protective shield comprising:

a body having:

a first face and a second face opposite the first face; and a first edge and a second edge opposite the first edge;

first buckle moieties on the first face;

second buckle moieties on the first face;

a first zipper moiety and a second zipper moiety, wherein:

the first and the second buckle moieties and first and second zipper moieties are configured to mate the protective shield to an identical second protective shield with a first portion of the protective shield adjacent the first edge of the body of the protective shield overlapping a second portion of the second protective shield adjacent the second edge of the body of the second protective shield.

22. The protective shield of claim 21 wherein:

in a mated condition of the protective shield and the second protective shield, first buckle moieties of the first protective shield are mated to the second buckle moieties of the second protective shield and the first zipper moiety of the first protective shield is mated to the second zipper moiety of the second protective shield.

23. The protective shield of claim 21 wherein:

the first face forms an attack side and the second face forms a body side; and a pair of carrying handles and wear straps are on the body side for a user to pass an arm under a carrying strap and hold an associated said carrying handle with the hand of the arm.

* * * * *